United States Patent [19]

Müller

[11] 4,350,327

[45] Sep. 21, 1982

[54] APPARATUS FOR REMOVING SUCCESSIVE SHEETS FROM A STACK OF OVERLAPPING SHEETS

[75] Inventor: Hans Müller, Zofingen, Switzerland

[73] Assignee: Grapha-Holding AG, Hergiswil, Switzerland

[21] Appl. No.: 192,353

[22] Filed: Sep. 30, 1980

[30] Foreign Application Priority Data

Oct. 17, 1979 [CH] Switzerland ..... 9326/79

[51] Int. Cl.[3] ..... B65H 39/02

[52] U.S. Cl. ..... 270/54; 271/225; 271/243

[58] Field of Search ..... 271/11, 225, 243, 244, 271/DIG. 9; 270/54, 56

[56] References Cited

U.S. PATENT DOCUMENTS 2,223,391 12/1940 Schweizer ..... 270/54 X 3,087,721 4/1963 McCain ..... 270/54

*Primary Examiner*—Richard A. Schacher

*Attorney, Agent, or Firm*—Kontler, Grimes & Battersby

[57] ABSTRACT

Apparatus for removing and opening successive folded sheets of a stack has a transfer conveyor whose gripper engages the folded backs of successive sheets and propels them into the elongated channel of a straight guide extending tangentially of the flanges of the transfer conveyor. When a sheet is released, its folded back is leading and the sheet continues to travel in the channel. Such sheet is braked by a stop which is moved at the speed of the sheet during disengagement of the sheet from the transfer conveyor, which has a clamping device that grips the folded back of the sheet, which moves at a gradually decreasing speed subsequent to engagement of its clamping device with the folded back to brake the sheet in the channel, and which is disengaged from the sheet not later than at the time when one or both front edge portions of the sheet are engaged by rotary spreading members which open the sheet during removal from the channel and drop the opened sheet onto a roof-shaped evacuating conveyor. The transfer conveyor cooperates with an auxiliary conveyor during movement of a sheet from the magazine toward and into the channel, and the auxiliary conveyor is disengaged from the sheet not later than when the stop begins to brake the sheet by reducing the speed of movement of the folded back in a direction deeper into the channel. The stop is moved forwardly simultaneously with removal of the sheet from the guide by the spreading members or immediately thereafter so as to extend across the path of the next sheet while such next sheet enters into and advances in the channel.

13 Claims, 2 Drawing Figures

APPARATUS FOR REMOVING SUCCESSIVE SHEETS FROM A STACK OF OVERLAPPING SHEETS

CROSS-REFERENCE TO RELATED CASES

The apparatus of the present invention serves to manipulate sheets of the type used in apparatus which are disclosed in commonly owned copending application Ser. No. 125,356 filed Feb. 28, 1980 by Hans Müller and in commonly owned U.S. Pat. Nos. 4,052,052 and 4,085,927 granted to Hans Müller.

BACKGROUND OF THE INVENTION

The present invention relates to apparatus for manipulating sheets in general, and more particularly to improvements in apparatus for manipulating folded sheets in bookbinding and/or analogous machines. Still more particularly, the invention relates to improvements in apparatus for removing successive folded sheets from a stack or row of neighboring sheets.

U.S. Pat. No. 3,199,862 discloses an apparatus wherein a transfer conveyor receives successive folded sheets from a stack and delivers such sheets into a guide wherein each inserted sheet is caused to abut against a stop in order to ensure predictable delivery into the range of a pair of rotary spreading devices which open up the sheet prior to transfer or descent of the opened sheet onto an evacuating conveyor. The patented apparatus and similar apparatus which are presently used for analogous purposes can process up to but normally fewer than 14,000 sheets per hour. If the output of such apparatus is increased beyond the just mentioned number, those portions of the sheets which strike against the stop are likely to be deformed or to rebound on impact against the stop. This can prevent predictable engagement of successive sheets by the aforementioned spreading devices of the opening mechanism which ensures that the folded sheets are converted into inverted V-shaped bodies capable of descending onto a saddle-like portion of the evacuating conveyor. Misalignment of folded sheets during transport from the stack onto the evacuating conveyor can result in prolonged interruptions of operation of the apparatus and substantial losses in output, even at the aforementioned rate of processing fewer than 14,000 sheets per hour.

OBJECTS AND SUMMARY OF THE INVENTION

An object of the invention is to provide a novel and improved apparatus for manipulating folded sheets in such a way that the output of the apparatus can exceed, by up to and even in excess of 50 percent, the output of heretofore known apparatus without affecting the predictability of transport of successive sheets between a stack or row and a take-off or evacuating conveyor.

Another object of the invention is to provide an apparatus of the just outlined character whose operation is more reliable than that of heretofore known apparatus regardless of whether the improved apparatus transfers folded sheets at a rate exceeding, matching or less than the maximum rate of processing of sheets in heretofore known apparatus.

A further object of the invention is to provide novel and improved means for controlling the positions of the aforementioned stop during various stages of transfer of successive sheets from the stack to the evacuating conveyor.

An additional object of the invention is to provide novel and improved means for supporting the sheet guide intermediate the stack and the evacuating conveyor.

An ancillary object of the invention is to provide the apparatus with novel and improved means for ensuring that various mobile components of the apparatus will be actuated and will perform predetermined movements in a preselected sequence and for preselected intervals of time.

The improved apparatus is used to manipulate sheets of the type having two panels or halves, a folded back which is integral with the panels and two registering or offset front edge portions opposite the folded back. The apparatus comprises a magazine or another suitable source of neighboring sheets including an outermost (e.g., lowermost or foremost) sheet, guide means defining an elongated path for successive sheets, and means for removing successive sheets from the source, preferably starting with the outermost sheet, and for introducing the removed sheets seriatim into the path so that the folded back of each sheet in the path constitutes the leader of the respective sheet during introduction of the sheet into and during travel of the sheet along the path under the action of the removing means. The removing means comprises a rotary transfer conveyor having means for gripping successive sheets during movement of the transfer conveyor from a first to a second angular position (during each revolution of the transfer conveyor) whereby the folded back of a sheet which is engaged by the gripping means enters into and advances along the path. The apparatus further comprises a stop or analogous braking means extending across the path which is defined by the guide means so as to be contacted by the oncoming folded back of a sheet which enters the path substantially at the time when the transfer conveyor reaches the second angular position and the sheet is released by the gripping means whereby the thus released sheet tends to continue to move along the path owing to its inertia and the folded back of such sheet bears against the braking means, and means for withdrawing successive sheets from the path counter to the aforementioned direction of introduction of sheets into the path. The withdrawing means includes one or more rotary spreading discs or analogous devices which engage the front edge portions of the sheet in the path and move the respective sheet counter to the direction of entry of sheets into the path. The apparatus further comprises means for moving the braking means in synchronism with the transfer conveyor so as to decelerate the sheet in the path while the sheet moves in the aforementioned direction subsequent to disengagement from the gripping means.

The moving means for the braking means comprises a device which can move the braking means between first (retracted) and second (foremost) end positions. The braking means moves toward the first end position while it decelerates a sheet in the path, and the braking means moves to the second end position simultaneously with or shortly after removal of the freshly braked sheet by the withdrawing means. In other words, while moving to its second or foremost position (lengthwise of the path which is defined by the guide means), the braking means can remain in contact with or trails behind the folded back of the sheet which is in the process of being removed from the path by the withdrawing means. The braking means preferably moves at or close to the peripheral speed of the transfer conveyor during initial contact with the folded back of a sheet in the path which is defined by the guide means. The braking means is thereupon decelerated to reduce the speed of the sheet before the sheet is engaged and entrained by the withdrawing means which proceeds to move the sheet counter to the direction of entry into the path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
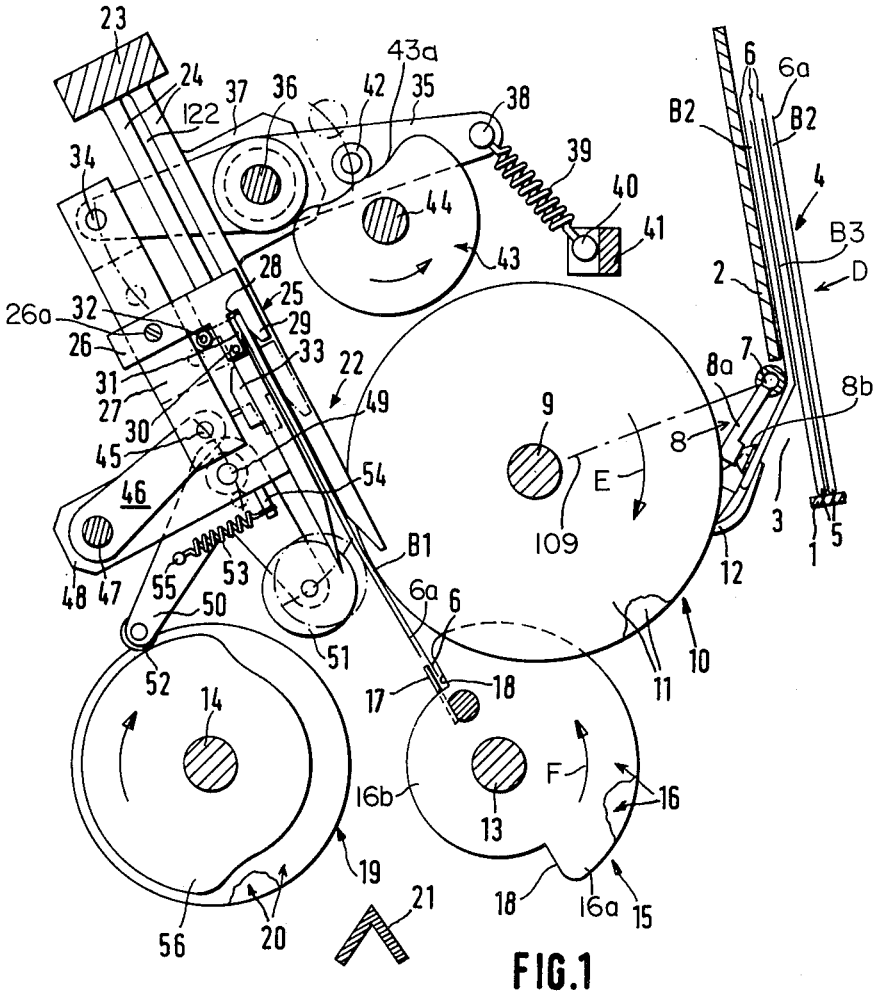
FIG. 1 is a schematic partly elevational and partly vertical sectional view of an apparatus which embodies the invention.

FIG. 1 illustrates an apparatus which serves to singularize stacked sheets B, i.e., to transfer successive sheets B from a stack 4 onto an evacuating or take-off conveyor 21 serving to transport the sheets in a direction at right angles to the plane of FIG. 1. The stack 4 is confined in a source of supply here shown as a magazine having a suitably inclined front wall 2 for the foremost sheet B2 of the stack. Each sheet is folded over itself, i.e., it comprises two panels, a folded back 5 which is integral with both panels and rests on the bottom wall 1 of the magazine, and two offset front edge portions 6 and 6*a*. Each edge portion 6 extends forwardly (upwardly, as viewed in FIG. 1) and beyond the respective edge portion 6*a*. The orientation of the magazine including the walls 1 and 2 is such that the edge portions 6, 6*a* of the sheets B2–Bn which form the stack 4 are located at a level above the folded backs 5. The lower end portion of the front wall 2 of the magazine terminates at a level above the bottom wall 1 so that these walls define an opening or gap 3 for removal of successive foremost or outermost sheets starting with the sheet B2. The last sheet of the stack 4 is shown at Bn. It goes without saying that the stack can be much bigger, and it is customary to provide means to continuously replenish the stack 4 so that the supply of sheets on the bottom wall 1 is not exhausted as long as the apparatus remains in use. FIG. 1 further shows that the upwardly projecting front edge portions 6 of the sheets in the magazine including the walls 1 and 2 are located ahead of the respective front edge portions 6*a*, as considered in the direction (arrow D) of advancement of successive sheets of the stack 4 toward the inclined front wall 2.

The means for removing successive foremost sheets B2 from the magazine includes one or more suction-operated extracting devices 8 pivotable with or on a hollow horizontal shaft 7 which is adjacent to the lower end of the front wall 2. The number of extracting devices 8 preferably exceeds one and each such extracting device may comprise a hollow arm 8*a* the lower end portion of which carries a suction cup 8*b*. The arrangement is such that the shaft 7 connects the interior of the arm 8*a* to the intake of a suitable suction generating device (e.g., a fan) while the arm 8*a* pivots in a clockwise direction, as viewed in FIG. 1, so that the suction cup 8*b* then adheres to the outermost or foremost sheet B2 in the region of the folded back 5 of such sheet and moves the lowermost part of the sheet B2 into and through the gap 3 and toward the peripheral surface of a rotary transfer conveyor 10 which forms part of the sheet removing means. The connection between the arms 8*a* of the extracting device 8 for the foremost sheets B2 and the aforementioned suction generating device peferably includes one or more bores or channels in the shaft 7. The means for sealing the suction generating device from the suction cups 8*b* in certain angular positions of the arms 8*a* and for establishing communication between the suction generating device and the suction cups 8*b* in other angular positions of the arms 8*a* is of conventional design and is not shown in FIG. 1. For example, such means can comprise a valve plate having an arcuate groove which is in permanent communication with the suction generating device and is free to communicate with the bore or bores of the shaft 7 in certain angular positions of the arms 8*a*.

The means for intermittently pivoting the arms 8*a* about the axis of the shaft 7 preferably derives motion from the drive shaft 9 for the transfer conveyor 10. For example, the operative connection (indicated by a phantom line 109) may include a cam on the shaft 9 and one or more followers attached to the shaft 7 to rock the shaft 7 back and forth in response to rotation of the drive shaft 9. The connection 109 preferably further includes means for biasing the just mentioned follower or followers against the cam on the shaft 9. The arrangement is such that the suction cups 8*b* are advanced toward the lower portion of the foremost or outermost sheet B2 in the magazine during each revolution of the shaft 9 and are advanced toward the positions shown in FIG. 1 during the same revolution to thereby move the folded back 5 of such sheet sufficiently close to the peripheral surface of the transfer conveyor 10 for engagement by gripping means (including the gripping element 12) which cause the folded back 5 to share the movement of the conveyor 10 with the result that the corresponding sheet is fully extracted from the magazine including the walls 1 and 2. FIG. 1 shows the lower portion of the foremost sheet B2 in the magazine in a position in which such lower portion is ready to be engaged by the gripping means on the conveyor 10 for entrainment in a clockwise direction, as viewed in FIG. 1 (see the arrow E).

The transfer conveyor 10 is actually a reel whose core is constituted by the shaft 9 and which further includes two spaced-apart coaxial disc-shaped flanges 11. The flanges 11 are fixed to the shaft 9. The gripping element 12 is a lever which is installed in the space between the flanges 11 and is actuatable by a stationary cam (not shown) so as to urge a freshly delivered lower sheet portion against the peripheral surfaces of the flanges 11 or against a check, not shown, in order to enable the conveyor 10 to extract such sheet from the magazine including the walls 1 and 2.

The transfer conveyor 10 is located at a level above the so-called spreading members 15 and 19 of a withdrawing means which serves to open up a folded sheet (B1) so that the opened-up sheet can be deposited on the roof-shaped portion of the evacuating conveyor 21 in a position in which the back 5 of the opened sheet rides on the crest of the conveyor 21. Reference may be had to commonly owned U.S. Pat. No. 4,085,927 to Müller granted Apr. 25, 1978. The spreading member 15 is mounted on a horizontal shaft 13 and includes two spaced apart coaxial discs or flanges 16 as well as a clamping lever 17 in the space between the two discs. Each of the discs 16 has a larger-diameter portion 16*a* and a smaller-diameter portion 16*b*. The peripheral surfaces of the portions 16*a* and 16*b* form part of circular cylindrical surfaces with a common center of curvature on the axis of the shaft 13. The clamping lever 17 is actuatable by a stationary cam (not shown) which causes it to temporarily urge one-half of a sheet (note the sheet B1 in FIG. 1) against the respective discs 16.

The other spreading member 19 is mounted on a horizontal shaft 14 which is parallel to the shafts 7, 9 and 13. This spreading member also comprises two spaced-apart coaxial discs or flanges 20 and a clamping lever (not shown) in the space between the discs 20. The means for pivoting the just mentioned clamping lever of the spreading member 19 is or may constitute a stationary cam which is not shown in FIG. 1. When an opened sheet is caused to descend onto the evacuating conveyor 21 so that its folded back 5 rides the crest of the illustrated triangular portion of the evacuating conveyor, a chain or the like with suitably configurated entraining elements engages the rear end of the thus deposited sheet B1 and advances it to a further station, e.g., to a station where several overlapping opened sheets are assembled into a signature (see the aforementioned U.S. Pat. No. 4,085,927).

The apparatus of FIG. 1 further comprises an elongated straight guide 22 for successive sheets which are delivered by the transfer conveyor 10. The guide 22 is substantially mirror symmetrical to the front wall 2 of the magazine with reference to a symmetry plane including the axis of the shaft 9, and the guide 22 defines an elongated straight channel 122 (constituting a path for successive removed sheets B1, B2 . . . Bn) which extends substantially tangentially of the flanges 11 of the transfer conveyor 10. The means for supporting the guide 22 in the frame of the apparatus inclues a crosshead 23 (this crosshead can be said to constitute a component part of the frame). The guide 22 comprises two plate-like portions 24 which are disposed in parallel planes and are formed with longitudinally extending slots so that each of the two plate-like portions 24 resembles a comb. A movable stop or braking means 25 extends through one or more slots of the plate-like portions 24, and its socket 26 is shiftable along an elongated tie rod or bar 27. One or more screws 26*a* or analogous fasteners are provided to releasably hold the socket 26 in a selected position with reference to the tie rod or bar 27. The stop 25 includes an arresting surface 28 and two cheeks 29, 30. The cheek 30 confines a clamping element 31 which is turnable on a pivot pin for a roller follower 32 and is biased against the cheek 29 by a suitable spring, not shown. The roller follower 32 tracks a cam 33 which is secured to the outer side of the guide 22. The parts 32, 33 constitute a means for actuating the clamping element 31, and the operation of such actuating means is regulated in synchronism with movements of the stop 25, for example, by the means for moving the stop 25 between two predetermined end positions (lengthwise of the channel 122).

The upper end portion of the tie rod or bar 27, as viewed in FIG. 1, is articulately connected (at 34) to one arm of a two-armed lever 35 which is fulcrumed at 36. The fulcrum 36 for the lever 35 is installed in a bracket 37 which is rigid with the guide 22. The other arm of the lever 35 carries a post 38 for one end portion of a helical spring 39. The other end portion of this spring is attached to a post 40 in the frame 41 of the apparatus. The spring 39 tends to pivot the lever 35 in a clockwise direction, as viewed in FIG. 1, so that a roller follower 42 on the right-hand arm of the lever 35 bears against the peripheral surface of a rotary disc-shaped cam 43 which is mounted on a horizontal camshaft 44. The camshaft 44 can rotate the cam 43 in a counterclockwise direction, as viewed in FIG. 1, and is driven in synchronism with the shaft 9 for the transfer conveyor 10.

The lower end portion of the tie rod or bar 27 is articulately connected with a lever 46 by a pin 45. The lever 46 is pivotable about the axis of a pin 47 which is installed in a bracket or extension 48 of the guide 22. When the camshaft 44 rotates, the levers 35 and 46 pivot between the solid-line and phantom-line end positions whereby the tie rod or bar 27 moves substantially axially or lengthwise, i.e., substantially up and down, as viewed in FIG. 1. This causes the stop 25 to move between a front end position (indicated by phantom lines) and a rear end position (indicated by solid lines). While the stop 25 moves from the rear toward the front end position, the roller follower 32 engages the cam 33. This causes the follower 32 to yield and to move the clamping element 31 outwardly and away from the cheek 29. When the stop 25 moves back to the rear end position, the follower 32 is disengaged from the cam 33 so that the clamping element 31 can yieldably engage the cheek 29 by moving inwardly.

The bracket 48 carries a further pivot pin 49 for a bell crank lever 50. That arm of the lever 50 which is nearer to the transfer conveyor 10 carries a rotary auxiliary conveyor 51 which is an idler roller. The other arm of the bell crank lever 50 carries a roller follower 52 serving to track the peripheral surface of a cam 56. The follower 52 is urged against the cam 56 by a prestressed helical spring 53 one end portion of which is attached to a post 55 on the left-hand arm of the bell crank lever 50 and the other end portion of which is attached to a post 54 on the bracket 48 of the guide 22. At the same time, the spring 53 urges the idler roller 51 toward the transfer conveyor 10, i.e., toward the flanges 11. The shaft 14 is rigidly connected with the cam 56 and is rotatable in a clockwise direction, as viewed in FIG. 1. The configuration of the cam 56 is such that the idler roller 51 is alternately biased against and moved away from the flanges 11 when the shaft 14 rotates.

Figure 2:
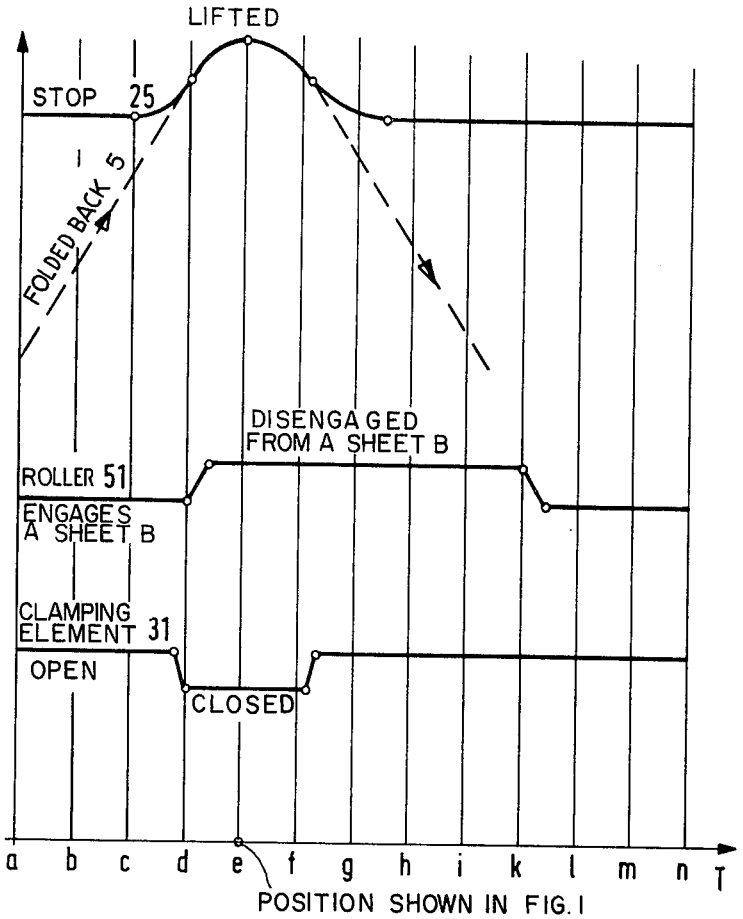
FIG. 2 is a diagram showing the positions of various component parts of the apparatus during successive stages of transfer of sheets from the source onto an evacuating conveyor.

FIG. 1 illustrates the parts of the apparatus in positions they assume when a sheet B1 which has been fully removed from the magazine including the walls 1 and 2 is in the process of being delivered into the range of the rotary spreading members 15 and 19. The sheet B1 is fully accommodated in the guide 22, i.e., it is already separated from the transfer conveyor 10 and its downwardly extending edge portion 6 is about to be attached to the spreading device 15. Thus, the clamping member 17 of the spreading device 15 is about to bias the edge portion 6 against the adjacent radial shoulders 18 of the discs 16. At the same time, the suction cups 8*b* on the arms 8*a* of the extracting device 8 have moved the lower portion of the foremost sheet B2 in the magazine toward the peripheral surfaces of the flanges 11 forming part of the transfer conveyor 10. The gripping element 12 of the transfer conveyor 10 already engages the folded back 5 of the sheet B2 and urges such folded back against the peripheral surfaces of the flanges 11 or against the aforementioned check of the gripping means on the conveyor 10 so that the sheet B2 is ready to be extracted from the magazine in response to clockwise rotation (arrow E) of the shaft 9. The parts of the apparatus assume the positions which are shown in FIG. 1 at the instant e which is shown in the diagram of FIG. 2. In this diagram, time (T) is measured along the abscissa, and the extent of movement of certain parts of the apparatus between their various positions is measured along the ordinate.

The shaft 9 continues to rotate the flanges 11 of the transfer conveyor 10 in a clockwise direction, as viewed in FIG. 1, beyond this illutrated first angular position and the shaft 13 drives the discs 16 of the spreading member 15 in a counterclockwise direction (arrow F). The clamping lever 17 biases the downwardly extending edge portion 6 of the sheet B1 against the adjacent shoulders 18 of the discs 16 so that the discs 16 begin to withdraw the sheet B1 from the channel or path 122 between the plate-like portions 24 of the guide 22. This automatically spreads or opens the sheet B1 because the member 15 moves the edge portion 6 away from the edge portion 6*a*. As the shaft 13 rotates clockwise, as viewed in FIG. 1, the edge portion 6*a* of the sheet B1 is moved nearer to the spreading member 19 whose clamping lever (not shown) biases the edge portion 6*a* against the discs 20 so that the sheet B1 opens up sufficiently to form an inverted V-shaped body which descends onto the triangular portion of the evacuating conveyor 21 to be advanced in a direction at right angles to the plane of FIG. 1. The clamping levers of the spreading members 15, 19 automatically release the respective edge portions 6 and 6*a* when the sheet B1 has been opposed to an extent which suffices to ensure its deposition on the saddle of the evacuating conveyor 21 in an optimum position for further transport.

The instant e in the diagram of FIG. 2 denotes that stage of operation when the withdrawal of the sheet B1 from the channel 122 between the plate-like portions 24 of the guide 22 begins. During the initial phase of such withdrawal of the sheet B1, the cam 43 pivots the lever 35 to thereby move the stop 25 toward its front or lower end position. The movement of the stop 25 is preferably delayed with reference to downward movement of the sheet B1 (this takes place subsequent to the instant f shown in the diagram of FIG. 2); at such time, the roller follower 32 engages the cam 33 and moves the clamping element 31 to open position whereby the stop 25 releases the sheet B1. The idler roller (auxiliary conveyor) 51 continues to remain spaced apart from the flanges 11 of the transfer conveyor 10 until that instant (k in the diagram of FIG. 2) when the sheet B1 is detached from the transfer conveyor 10. The stop 25 then remains in the front end position to await the arrival of the folded back 5 of the next sheet (B2).

In the position of FIG. 1, the gripping element 12 of the transfer conveyor 10 rotates with the shaft 9 and moves toward and engages the folded back 5 of the sheet B2 so that the folded back 5 is biased against the flanges 11 or against the aforementioned cheek of gripping means on the conveyor 10. Therefore, the sheet B2 is extracted from the magazine in response to further clockwise rotation of the transfer conveyor 10. The idler roller 51 is biased against the flanges 11 of the transfer conveyor 10 by the spring 53 before the gripping element 12 brings the folded back 5 of the sheet B2 into the range of this idler roller. This takes place at the instant d (see the diagram of FIG. 2). At such time, the cam 43 triggers the return movement of the stop 25 to the other (upper) end position (note the instant c in the diagram of FIG. 2). When the gripping element 12 advances beyond the idler roller 51, it is disengaged from the folded back 5 of the sheet B2 (in the second angular position of the transfer conveyor 10) so that the sheet B2 is held in engagement with the flanges 11 under the action of the spring-biased idler roller or auxiliary conveyor 51. The speed of movement of the sheet B2 does not change because it is determined by the peripheral speed of the flanges 11, i.e., by the peripheral speed of the transfer conveyor 10. When the folded back 5 of the sheet B2 approaches the stop 25 (note the instant c in the diagram of FIG. 2), the roller follower 42 begins to track that portion (43*a*) of the cam 43 which is nearer to the axis of the camshaft 44 whereby the stop 25 begins to move toward its rear end position. The folded back 5 of the sheet B2 then strikes against the surface 28 of the stop 25 while the stop 25 moves upwardly at or close to the exact speed of the sheet. When the folded back 5 (leader of the sheet B2) strikes against the surface 28 of the stop 25, the idler roller 51 is fully lifted off the peripheral surfaces of the flanges 11 (see the instant d in the diagram of FIG. 2). At the same time, the roller follower 32 which carries the clamping element 31 is disengaged from the cam 33 so that the clamping element 31 turns to its closed position under the action of the associated spring and engages the folded back 5 of the sheet B2. The stop 25 then continues to move toward its upper end position (see the instant e in the diagram of FIG. 2) to brake the sheet B2 which continues to penetrate into the channel 122 owing to its inertia. At the same time, the clamping element 17 of the spreading member 15 engages the front edge portion 6 of the sheet B2 and pushes it against the shoulders 18 between the larger- and smaller-diameter portions 16*a*, 16*b* of the discs 16 forming part of the spreading member 15. As the shaft 13 rotates in the counterclockwise direction, the spreading member 15 begins to withdraw the sheet B2 from the channel or path 122 between the plate-like portions 24 of the guide 22. At the same time, the stop 25 begins to move toward its front or lower end position and accelerates the sheet B2 to the same extent as the spreading member 15. The speed of movement of the stop 25 is reduced shortly after the instant f (see the diagram of FIG. 2); at such time, the roller follower 32 engages the cam 33 whereby the clamping element 31 is moved to its open position and releases the trailing portion (folded back 5) of the sheet B2. The clamping element of the spreading member 19 then engages the respective front edge portion 6*a* of the sheet B2 and the sheet is opened up. In the next step, the spreading members 15 and 19 release the sheet B2 so that the latter descends onto the triangular saddle of the evacuating conveyor 21. The stop 25 remains in the front or lower end position up to the instant c and the idler roller 51 is again biased against the flanges 11 of the conveyor 10 as soon as the spreading members 15 and 19 cause the folded back 5 of the sheet B2 to advance downwardly and beyond the locus of engagement between the flanges 11 and the idler roller 51 (note the instant k in the diagram of FIG. 2). At the same time or immediately thereafter, the gripping element 12 advances the folded back 5 of the next sheet (B3) past the idler roller 51 and thereupon releases the folded back of such sheet. The folded back 5 of the sheet B3 is then introduced into the channel or path 122 between the plate-like portions 24 of the guide 22 and the aforedescribed sequence of steps is repeated in the same way as explained in connection with the preceding sheet B2.

It will be noted that the means for moving the stop 25 between its end positions in synchronism with the operation of the transfer conveyor 10 and spreading members 15, 19 includes a linkage (levers 35, 46 and tie rod 27) and cam means 43 for moving the linkage relative to the guide 22.

An important advantage of the improved apparatus is that the stop 25 moves upwardly while the folded back 5 of a sheet is moved upwardly into the channel 122 between the portions 24 of the guide 22, i.e., the sheet cannot rebound upon impact against the surface 28. Furthermore, the stop 25 furnishes a braking action during movement to its upper end position and assists the acceleration of successive sheets by the spreading members 15 and 19. This renders it possible to avoid deformation of sheets, even if the apparatus is operated at an extremely high speed so that the number of processed sheets greatly exceeds that in a conventional apparatus. Moreover, the reproducibility of transfer of successive sheets into the range of the spreading members 15 and 19 is surprisingly high in spite of the normally extremely high speed at which the apparatus delivers successive sheets from the stack in the magazine including the walls 1, 2 onto the evacuating conveyor 21. The delivery of sheets onto the evacuating conveyor 21 is predictable, i.e., each and every sheet descends onto the conveyor 21 in the same position as the preceding sheet. This contributes to the quality of products into which the sheets are assembled and reduces the number of rejects.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. Apparatus for manipulating sheets of the type having two panels, a folded back which is integral with said panels and two front edge points opposite the folded back, comprising a source of neighboring sheets; guide means defining an elongated path for the sheets; means for removing successive sheets from said source and for introducing the removed sheets seriatim into said path so that the folded back of each sheet in said path constitutes the leader of the respective sheet during introduction of the sheet into said path, comprising a rotary transfer conveyor having means for gripping successive sheets during movement of said conveyor from a first to a second angular position during each revolution of said conveyor whereby the folded back of a sheet which is engaged by said gripping means enters into and advances along said path; braking means extending across said path so as to be contacted by the folded back of a sheet which enters said path substantially at the time said conveyor reaches said second angular position and the sheet is released by said gripping means whereby the thus released sheet tends to continue its movement along said path owing to inertia and the folded back of such sheet bears against said braking means; means for withdrawing successive sheets from said path, including means for engaging at least one front edge portion of the sheet in said path and for moving the respective sheet counter to the direction of entry of the sheet into said path; and means for moving said braking means in synchronism with said conveyor so as to decelerate the sheet in said path while such sheet moves in said direction subsequent to disengagement from said gripping means.

2. The apparatus of claim 1, wherein said moving means includes a device for moving said braking means between first and second end positions, said braking means moving towards said first end position while decelerating a sheet in said path and to said second end position simultaneously with or shortly after removal of the braked sheet by said withdrawing means.

3. The apparatus of claim 2, wherein said withdrawing means includes means for opening the sheets during and/or subsequent to withdrawal from said path.

4. The apparatus of claim 1, wherein said moving means includes means for moving said braking means in said direction and at least substantially at the peripheral speed of said transfer conveyor at the time of initial contact between said braking means and the back of the sheet in said path.

5. The apparatus of claim 1, wherein said braking means comprises a sheet clamping device, actuating means operable to move said clamping device between open and closed positions, and means for regulating the operation of said actuating means so as to engage said clamping device with the folded back of a sheet in said path while said braking means decelerates such sheet.

6. The apparatus of claim 5, wherein said moving means includes means for moving said braking means lengthwise of said path between first and second end positions and said braking means moves to said first end position while said clamping device engages the back of the sheet in said path, said braking means moving to said second end position counter to said direction substantially simultaneously with removal of the sheet from said path by said withdrawing means and said regulating means being arranged to open said clamping device at a time while the speed of said braking means during movement in said direction at least approximates the peripheral speed of said conveyor.

7. The apparatus of claim 5, wherein said clamping device comprises a clamping element and means for yieldably biasing said element into engagement with the back of a sheet in said path in the closed position of said clamping device.

8. The apparatus of claim 1, further comprising auxiliary conveyor means for assisting said transfer conveyor in advancing successive sheets from said source into said path and means for disengaging said auxiliary conveyor means for a sheet in said path when the speed of said braking means in said direction at least approximates the peripheral speed of said transfer conveyor.

9. The apparatus of claim 1, wherein said elongated path is substantially tangential to said transfer conveyor.

10. The apparatus of claim 1, wherein said moving means comprises a linkage and cam means for moving said linkage relative to said guide means.

11. The apparatus of claim 1, wherein said removing means further comprises suction-operated means for moving the folded backs of successive sheets in said source into the range of said transfer conveyor so that the transfer conveyor removes a sheet from said source during each revolution thereof.

12. The apparatus of claim 1, further comprising means for adjustably securing said braking means to said moving means.

13. The apparatus of claim 1, wherein said moving means includes portions mounted on said guide means.

* * * * *

UNITED STATES PATENT AND TRADEMARK OFFICE

CERTIFICATE OF CORRECTION

PATENT NO. : 4,350,327

DATED : September 21, 1982

INVENTOR(S) : Hans MÜLLER

It is certified that error appears in the above-identified patent and that said Letters Patent are hereby corrected as shown below:

Col. 4, line 14, "peferably" should read --preferably--;
line 61, "check" should read --cheek--.
Col. 7, line 4, "check" should read --cheek--;
line 26, "clockwise" should read --counterclockwise--;
line 37, "opposed" should read --opened--.
Col. 9, line 50, "points" should read --portions--.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*